US008938830B2

(12) United States Patent
Paperno

(10) Patent No.: US 8,938,830 B2
(45) **Date of Patent: *Jan. 27, 2015**

(54) NECK, SPINE, AND SPINAL CORD SUPPORT DEVICE FOR NEWBORN BABY AND INFANT, AND BLANKET ASSEMBLY FOR SAME

(71) Applicant: Steven Paperno, Westlake Village, CA (US)

(72) Inventor: Steven Paperno, Westlake Village, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/191,060

(22) Filed: Feb. 26, 2014

(65) Prior Publication Data

US 2014/0250595 A1 Sep. 11, 2014

Related U.S. Application Data

(63) Continuation of application No. 13/793,579, filed on Mar. 11, 2013, now Pat. No. 8,671,486.

(51) Int. Cl.

| | |
|---|---|
| ***A47C 16/00*** | (2006.01) |
| ***A41B 13/06*** | (2006.01) |
| ***A47D 13/00*** | (2006.01) |
| *A41D 13/05* | (2006.01) |

(52) U.S. Cl.

CPC ..... *A41B 13/06* (2013.01); *A47D 13/00* (2013.01); *A41D 13/0512* (2013.01)

USPC ..... 5/655; 5/485; 5/494; 2/69.5

(58) Field of Classification Search

USPC ..... 5/655, 603, 632, 485, 494, 502, 636, 5/637, 643, 671, 622, 631; 2/69.5; 128/845, 870; 224/158; D6/388, 586, D6/597, 601, 603, 605; D9/666, 717

See application file for complete search history.

(56) References Cited

U.S. PATENT DOCUMENTS

| | | | | |
|---|---|---|---|---|
| 309,678 | A | | 12/1884 | Aubin |
| D139,630 | S | * | 12/1944 | Wade ..... D6/388 |
| 2,876,459 | A | * | 3/1959 | Ackerson ..... 4/572.1 |
| 3,443,066 | A | * | 5/1969 | Weibel ..... 219/527 |
| 4,087,874 | A | | 5/1978 | Callaway et al. |
| D267,678 | S | * | 1/1983 | Breen ..... D6/502 |
| 4,788,726 | A | | 12/1988 | Rafalko |
| 5,333,769 | A | * | 8/1994 | Skroski ..... 224/158 |
| 5,546,620 | A | | 8/1996 | Matthews |
| 5,551,108 | A | | 9/1996 | Butler, III |
| 5,551,109 | A | * | 9/1996 | Tingley et al. ..... 5/655 |
| 6,036,263 | A | | 3/2000 | Gold |
| 6,321,403 | B1 | | 11/2001 | Matthews |
| 6,513,164 | B1 | | 2/2003 | Hears |

(Continued)

*Primary Examiner* — Nicholas Polito

(74) *Attorney, Agent, or Firm* — Knobbe Martens Olson & Bear, LLP

(57) ABSTRACT

A blanket assembly for swaddling an infant (e.g., newborn baby) includes a blanket body defining a pocket between an upper layer and a lower layer of the body at one end of the blanket body, the pocket accessible via an opening selectively closeable to seal the pocket. A neck, spine and spinal cord support device of a semi-rigid material is removably insertable in the pocket of the blanket body and secured within the blanket by the pocket so as to maintain the support device in a substantially fixed position within the blanket body. The support device supports the head, neck, spine and spinal cord of a newborn baby or infant when the infant is laid on the blanket body in a supine position and wrapped in the blanket body, so as to inhibit injury to the infant's head, neck, spine and spinal cord while carried by a person.

13 Claims, 15 Drawing Sheets

(56) References Cited

U.S. PATENT DOCUMENTS

| | | | | |
|---|---|---|---|---|
| D474,637 | S * | 5/2003 | Scheetz | D6/601 |
| 7,003,832 | B2 * | 2/2006 | Wilson | 5/655 |
| D523,680 | S * | 6/2006 | Burke | D6/601 |
| 7,076,819 | B2 | 7/2006 | Trani et al. | |
| 7,584,515 | B2 | 9/2009 | Jones et al. | |
| D610,853 | S * | 3/2010 | Straub | D6/601 |
| 8,032,958 | B2 * | 10/2011 | Pieta et al. | 5/494 |
| D650,558 | S | 12/2011 | Ruse-Petersen | |
| 8,074,312 | B2 | 12/2011 | Tullous | |
| 8,191,188 | B2 | 6/2012 | Kaplan et al. | |
| 8,671,486 | B1 * | 3/2014 | Paperno | 5/655 |
| 2002/0108176 | A1 | 8/2002 | Ragen | |
| 2006/0010600 | A1 | 1/2006 | Kendy | |
| 2006/0042013 | A1 * | 3/2006 | Madsen | 5/637 |
| 2007/0157392 | A1 | 7/2007 | Ragen | |
| 2008/0216246 | A1 | 9/2008 | Groves | |
| 2010/0192305 | A1 | 8/2010 | Telegadis et al. | |
| 2010/0257653 | A1 | 10/2010 | Pitts | |
| 2011/0197364 | A1 | 8/2011 | Wadia | |
| 2011/0197365 | A1 * | 8/2011 | Wadia | 5/655 |

* cited by examiner

NECK, SPINE, AND SPINAL CORD SUPPORT DEVICE FOR NEWBORN BABY AND INFANT, AND BLANKET ASSEMBLY FOR SAME

INCORPORATION BY REFERENCE TO ANY PRIORITY APPLICATIONS

This application is a continuation application of U.S. application Ser. No. 13/793,579, filed Mar. 11, 2013, which is hereby incorporated by reference in its entirety and should be considered a part of this specification.

BACKGROUND

1. Field

The present invention is directed to a neck, spine and spinal cord support device for a new born baby or infant, and more particularly to a blanket assembly incorporating the support device.

2. Description of the Related Art

The body parts most susceptible to injury in an infant's body are the head, neck, spine and spinal cord, particularly in newborn babies and infants up to 6 months old. To this day there is a possibility that challenges, from learning disabilities to Autism, may be caused from injury to the spinal cord at these early stages in an infant's life. Babies rely on their care takers (e.g., parents) to hold and support their head, spine, neck and spinal cord without jarring them, all the while comforting them, swaddling them, and/or rocking them in their arms, as well as feeding them. A slight jar or jolt can possibly cause short term or long term (e.g., permanent) damage to the spinal cord, causing challenges later on in life for the child, such as learning disabilities and Autism.

New parents and others can struggle to properly hold newborn babies in a way that adequately supports the baby's head, neck, spine and spinal cord, especially when the person has not previously held newborn babies. Proper support to the head, neck, spine and spinal cord of the newborn baby is important and lack of such proper support can result in discomfort and even injury to the baby (e.g., injury to the head or spinal cord of the baby), as discussed above.

Often, people will hold the baby by holding the baby in one arm so that the baby's back (spine and spinal cord) is supported by the forearm and the baby's head and neck is supported between the person's forearm and upper arm. However, this method often does not allow the person the freedom to easily take care of other tasks with their free arm because they either use two arms to hold the baby or are nervous about maintaining proper support for the baby so that they instead opt to put the baby down (e.g., in a crib) before proceeding to handle other tasks.

Accordingly, there is a need for an improved system for ensuring proper support for the baby's head, neck, spine and spinal cord while being held by a person, and for allowing the person to readily perform other tasks with their free arm while securely holding the baby with their other arm.

SUMMARY

In accordance with one embodiment, a blanket assembly for swaddling an infant is provided. The blanket assembly comprises a blanket body defining a pocket between an upper layer and a lower layer of the body at one end of the blanket body, the pocket accessible via an opening selectively closeable to seal the pocket. The blanket assembly also comprises a neck, spine and spinal cord support device of a semi-rigid material, the support device removably insertable in the pocket of the blanket body and secured within the blanket by the pocket so as to maintain the support device in a substantially fixed position within the blanket body. The support device is configured to support the head, neck, spine and spinal cord of an infant when the infant is laid on the blanket body in a supine position and wrapped in the blanket body, and so as to inhibit injury to the infant's head and back while carried by a person.

In accordance with another embodiment, a blanket assembly for swaddling an infant is provided. The blanket assembly comprises a blanket body defining a pocket between an upper layer and a lower layer of the body at one end of the blanket body, the pocket accessible via an opening selectively closeable to seal the pocket. The blanket assembly also comprises a monolithic neck, spine and spinal cord support device of a semi-rigid material and comprising a generally planar distal portion and a concave section at a proximal portion thereof, the support device removably insertable in the pocket of the blanket body and secured within the blanket by the pocket so as to maintain the support device in a substantially fixed position within the blanket body. The support device is configured to support the head, neck, spine and spinal cord of an infant when the infant is laid on the blanket body in a supine position and wrapped in the blanket body, the infant's head being supported by the concave portion and the infant's torso being supported by the distal portion, so as to inhibit injury to the infant's head and back while carried by a person.

In accordance with another embodiment, a neck, spine and spinal cord support device for supporting an infant is provided. The support device comprises a monolithic body of a semi-rigid material, comprising a generally planar distal portion and a proximal portion having a concave section. The body is configured to support a head, neck, spine and spinal cord of an infant when the infant is laid in supine position on the body, the concave section configured to at least partially receive the infant's head, the distal portion configured to support the infant's back.

DETAILED DESCRIPTION

Figure 1:
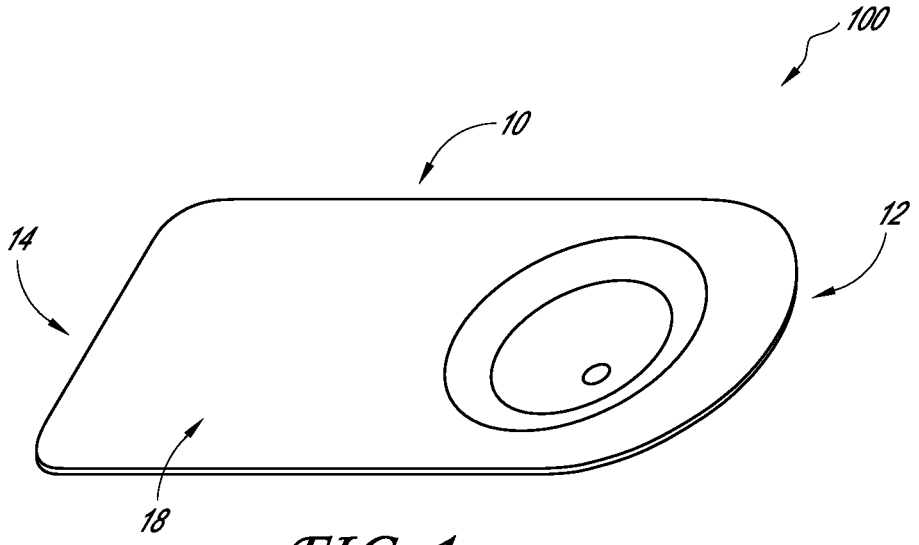
FIG. 1 is a schematic top perspective view of one embodiment of a neck, spine and spinal cord support device for use with a corresponding blanket for supporting a newborn baby or infant.
Figure 2:
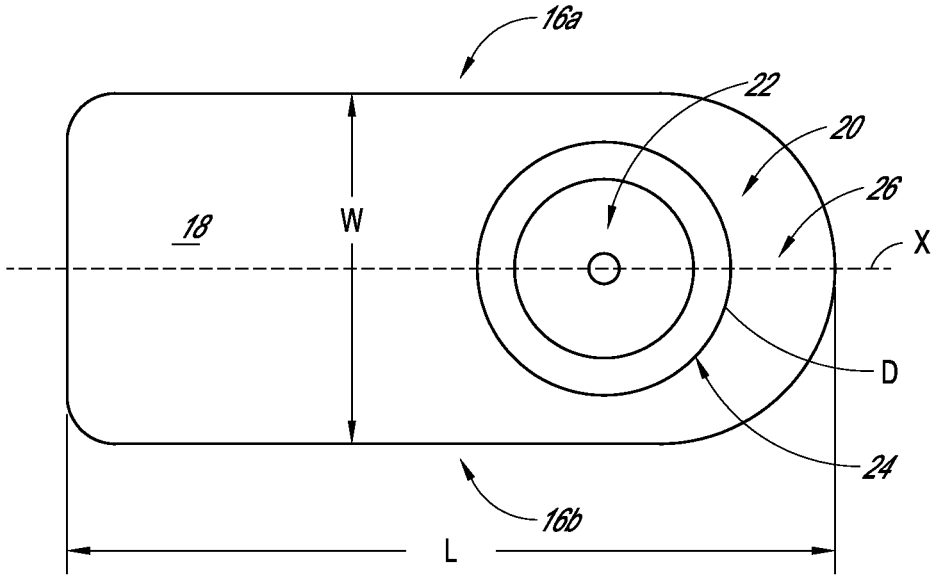
FIG. 2 is a schematic top planar view of the support device of FIG. 1.
Figure 3:
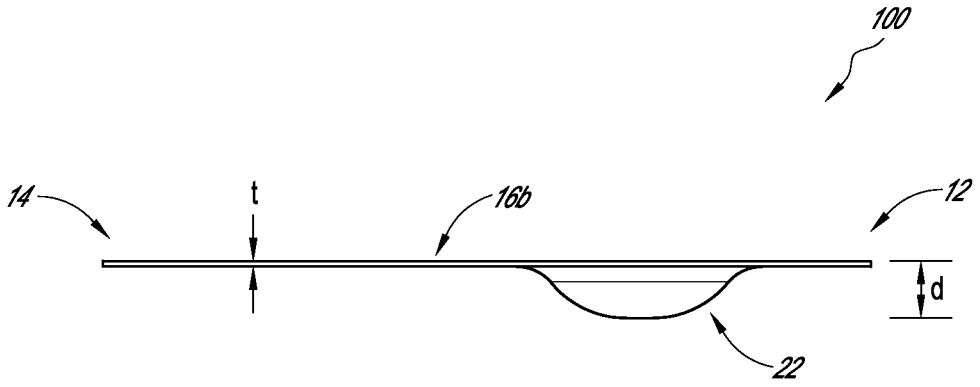
FIG. 3 is a schematic side elevational view of the support device of FIG. 1.
Figure 4:
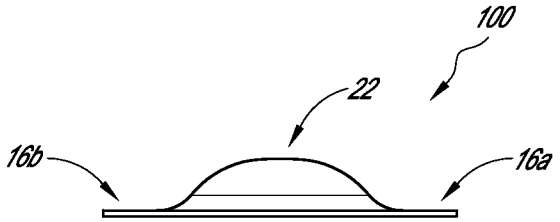
FIG. 4 is a schematic front or rear elevational view of the support device of FIG. 1.
Figure 5A:
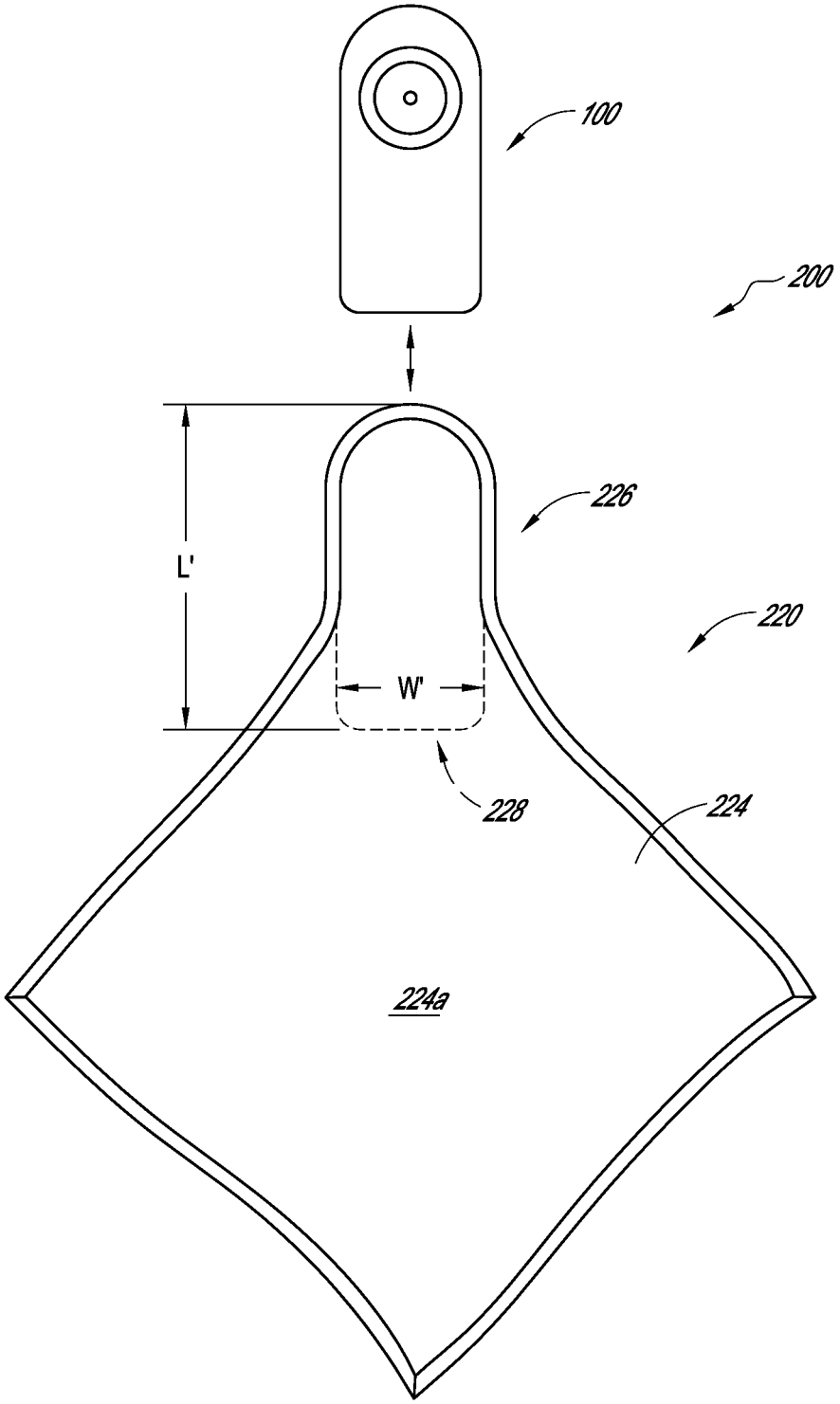
FIG. 5A is a schematic exploded view of one embodiment of a blanket that holds the support device, and the support device of FIG. 1.
Figure 5B:
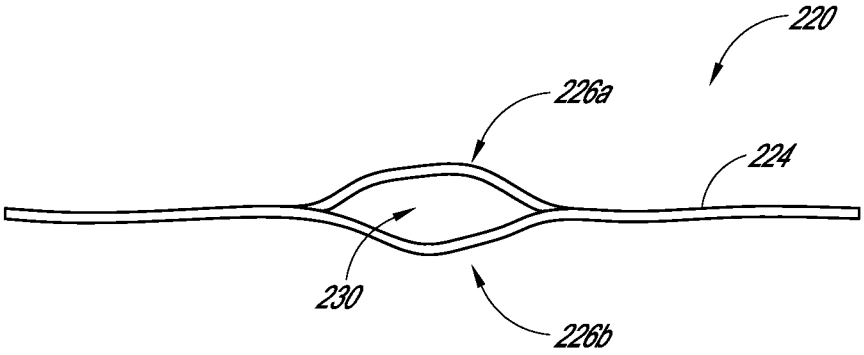
FIG. 5B is a schematic end view of the blanket of FIG. 5A showing an opening that receives the support device therein.
Figure 6:
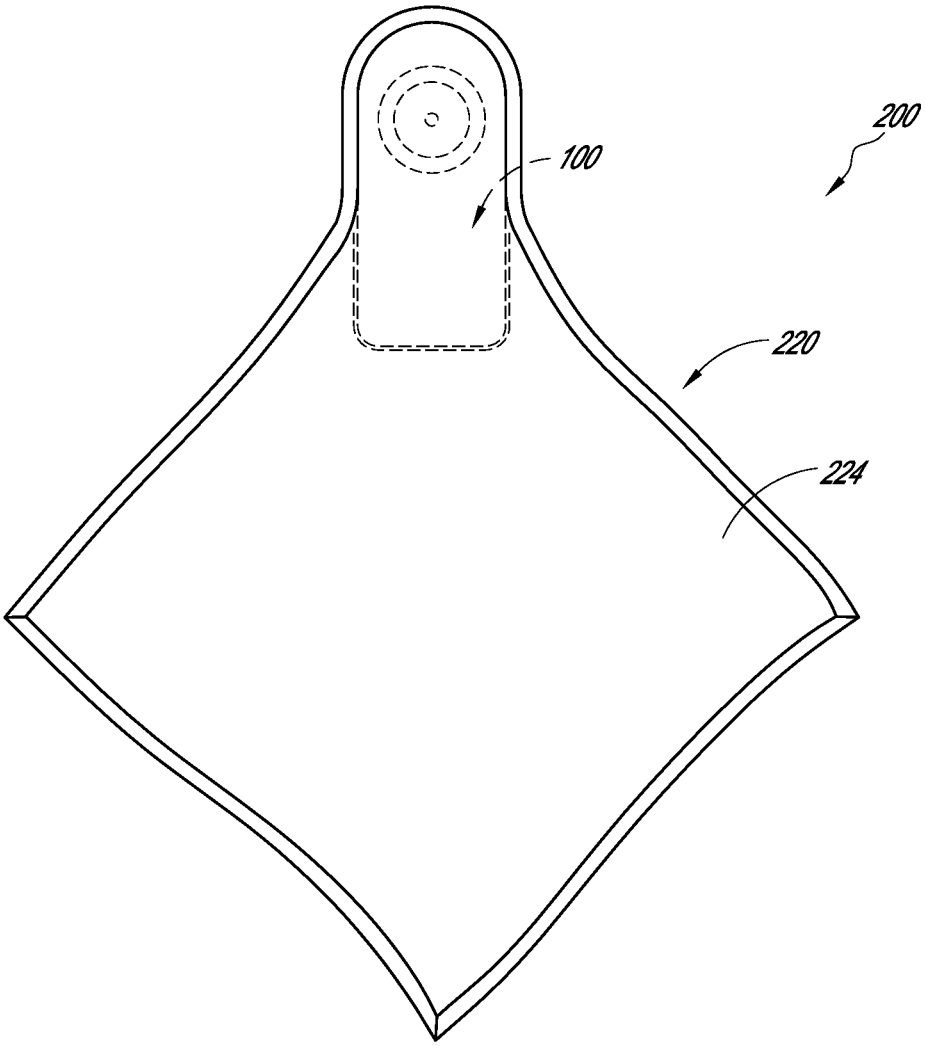
FIG. 6 is a schematic top planar view of the blanket and support device of FIG. 5 in an assembled form.

FIGS. 1-4 show one embodiment of a neck, spine and spinal cord support device 100 that can be used to support the head, neck, spine and spinal cord of an infant, such as a newborn baby. The support device 100 advantageously provides consistent alignment of the head, neck, spine and spinal cord for the baby and can be used until the baby's neck and back muscles sufficiently strengthen (e.g., when the baby is able to support their head without assistance). The support device 100 can have a body 10 that extends from a proximal edge 12 to a distal edge 14 and between a medial edge 16*a* and a lateral edge 16*b*. In the illustrated embodiment, the proximal edge can be curved (e.g., extend along a curve between the medial and lateral edges 16*a*, 16*b*) and the distal edge 14 and be generally straight. However in other embodiments, the proximal edge 12 can be generally straight. In still another embodiment, the distal edge 14 can be curved between the medial and lateral edges 16*a*, 16*b*. In one embodiment, the medial and lateral edges 16*a*, 16*b* can be generally parallel along at least a portion of their length.

In one embodiment, the body 10 can have a distal portion 18 and a proximal portion 20. In one embodiment, the distal portion 18 can be generally planar and have a width W (defined between the medial and lateral edges 16*a*, 16*b*) sized to wider than the torso of an infant (e.g., newborn baby). In one embodiment, the width W can be between about 5 inches and about 9 inches. In another embodiment, the width W can be about 7 inches. The body 10 can have a length L (defined between the proximal and distal edges 12, 14) sized to be longer than the torso of an infant (e.g., newborn baby) such that the infant's buttocks rest on the distal portion 18 proximal of the distal edge 14. In one embodiment, the length L can be between about 12 inches and about 18 inches. In another embodiment, the length L can be about 15 inches. The body 10 can have a thickness t of between about 0.05 inches and about 1 inch. In another embodiment, the thickness t can be about 0.08 inches. In one embodiment, the distal portion 18 can be substantially flat. However, the body 10 can have other lengths L, widths W and thickness t values, higher or lower, than those discussed above.

With continued reference to FIGS. 1-4, the proximal portion 20 can have a concave section 22 with a generally circular outermost perimeter 24. In one embodiment, the perimeter 24 can have a diameter D of between about 4 inches and about 6 inches. In another embodiment, the diameter D can be about 5 inches. The concave section 22 can have a radius of curvature r of between abut 1.5 inches and about 2.5 inches. In another embodiment, the radius of curvature r can be about 2 inches. In the illustrated embodiment, the concave section 22 is aligned generally along the axis X of the device 100. Additionally, a boundary portion 26 extends between the outermost perimeter 24 of the concave section 22 and the proximal edge 12 and medial and lateral edges 16*a*, 16*b*. In one embodiment, the boundary portion 26 can be between about 1 inch and about 2 inches in width. In one embodiment, the boundary portion 26 is wider between the proximal edge 12 and the concave section 22 than between the concave section 22 and the medial and lateral edges 16*a*, 16*b*. In another embodiment, the boundary section 26 has the same width between the concave section 22 and the proximal, lateral and medial edges 12, 16*a*, 16*b*. The concave section 22 can be shaped to at least partially receive the head of an infant (e.g., newborn baby) therein so as to comfortably cradle the infant's head therein. For example, the diameter D can be sized so as to be greater than an average distance between the sides of the infant's head so that the perimeter does not tightly fit on the infant's head. Additionally a depth d of the concave section 22 is preferably sized so that between about 5% and about 25% of the infant's head extends into the concave section 22; in another embodiment, the depth d of the concave section 22 can be sized so that less or more of the infant's head extends into the concave section 22 than noted above. In another embodiment, the depth d is preferably sized so that the boundary portion 26 is disposed below the infant's ears when the infant's head rests in the concave section 22. In still another embodiment, the depth d is preferably sized so that when the infant lies on the support device 100, the infant's spine is aligned from the buttocks to the head of the infant. In one embodiment, the depth d can be between about two inches and about three inches. However, the proximal portion 20 can have other suitable dimensions, including other suitable depths.

In one embodiment, the support device 100 can be made of a rigid or semi-rigid material. For example, in one embodiment the device 100 can be made of a plastic material (e.g., a thermoset or thermoplastic material), such as polyurethane, polyester, polystyrene, low-density or high-density polyethylene (PE), polypropylene (PP), and polyvinyl chloride (PVC), and polytetrafluoroethylene. However, other suitable materials can be used, such as hard plastic or resilient materials. In one embodiment, the device 100 can be molded (e.g., injection molded) or manufactured using a cast. However, other suitable methods can be used to manufacture the device 100. The device 100 can preferably support an infant weighing between about 4 lbs and about 18 lbs, and being between about 16 inches and about 26 inches in length. In the illustrated embodiment, the infant can be supported by the device 100 so that the infant's head rests on the concave section and the infant's back (e.g., including the buttocks) rests on the distal portion 18 so that the infants head and spine are supported when the infant lies (e.g., is in a supine position) on the device 100. The device 100 advantageously provides appropriate support to the infant's head, neck, spine and spinal cord while the infant is held or carried in a person's arm (e.g., carried by a person that is experience, inexperienced or unfamiliar with respect to holding infants correctly).

FIGS. 5A-10 show one embodiment of a baby blanket assembly 200 that includes a blanket 220 (e.g., a swaddle blanket) and can incorporate the support device 100 therein. The blanket 220 can be made of a fabric, such as cotton. However, the blanket 220 can be made of other suitable blanket materials, such as wool, fleece, etc. The blanket 220 can have a body 224 with a top surface 224*a* and a bottom surface 224*b*. In the illustrated embodiment, the blanket 220 has a generally square shape when in an unfolded orientation, with a proximal portion 226 having a curved shape that generally corresponds to the curved proximal edge 12 of the support device 100. In other embodiments, the blanket 220 can have other suitable shapes, such as rectangular, circular, triangular and oval. In still other embodiments, the proximal portion 226 can have other suitable shapes that correspond to a shape of the proximal edge of the device 100.

The proximal portion 226 can define a pocket 228 between an upper layer 226*a* and a lower layer 226*b* of the blanket 220 that can be accessed through an opening 230 at the edge of the proximal portion 226. The pocket 228 is preferably sized and shaped to removably receive the support device 100 therein so that the device 100 is enclosed between the layers 226*a*, 226*b* of the blanket 220. In one embodiment, the pocket 220 is sized and shaped so as to securely hold the device 100 in the pocket 228 so that the device 100 does not shift once incorporated into the blanket 220. For example, in one embodiment, the pocket 28 has a length L' and width W' that is generally the same as the length L and width W of the device 100. The opening 230 can be selectively closed with one or more fasteners 232 (see FIG. 7). In one embodiment, the one or more fasteners 232 can be buttons. In another embodiment, the fasteners 232 can be snap fasteners. In still another embodiment, the one or more fasteners 232 can be a zipper. In still another embodiment, the one or more fasteners 232 can be a hoop-and-loop fastener, such as VELCRO®.

Figure 7:
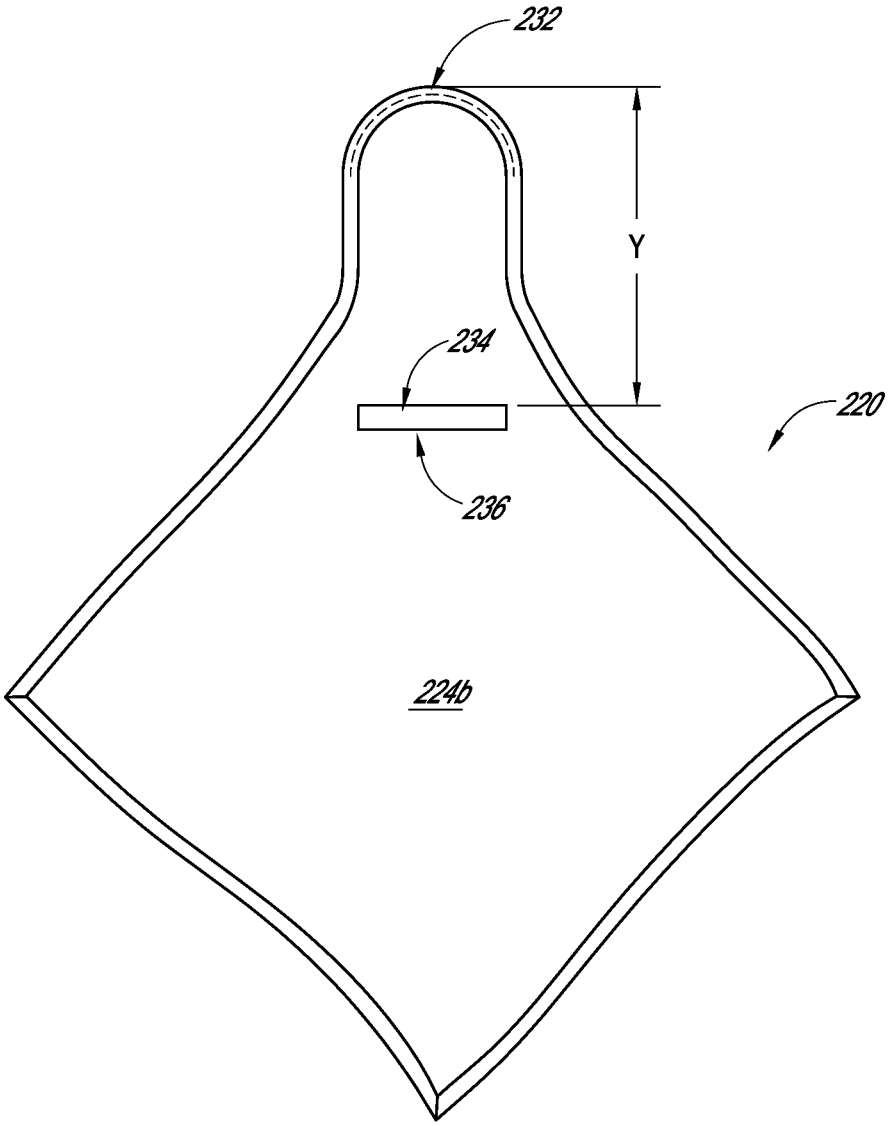
FIG. 7 is a schematic bottom planar view of one embodiment of a blanket for use with the support device of FIG. 1.

With reference to FIG. 7, the blanket 220 can have a strap or hand pocket 234 on the bottom surface 224*b* that defines an opening 236 into which or through which a user can at least partially insert a portion (e.g., fingers, palm) of their hand to provide an additional safety, stability and support for the infant once wrapped with the blanket, as discussed further below. In one embodiment, the strap 234 is located a distance Y from the edge of the proximal portion 226. In one embodiment, the distance Y is between about 7 inches and about 15 inches. In another embodiment the distance Y is about 10 inches. Advantageously, the distance Y can be such that the user's hand would be disposed under the support device 100, such as halfway along the length of the support device 100.

Figure 8:
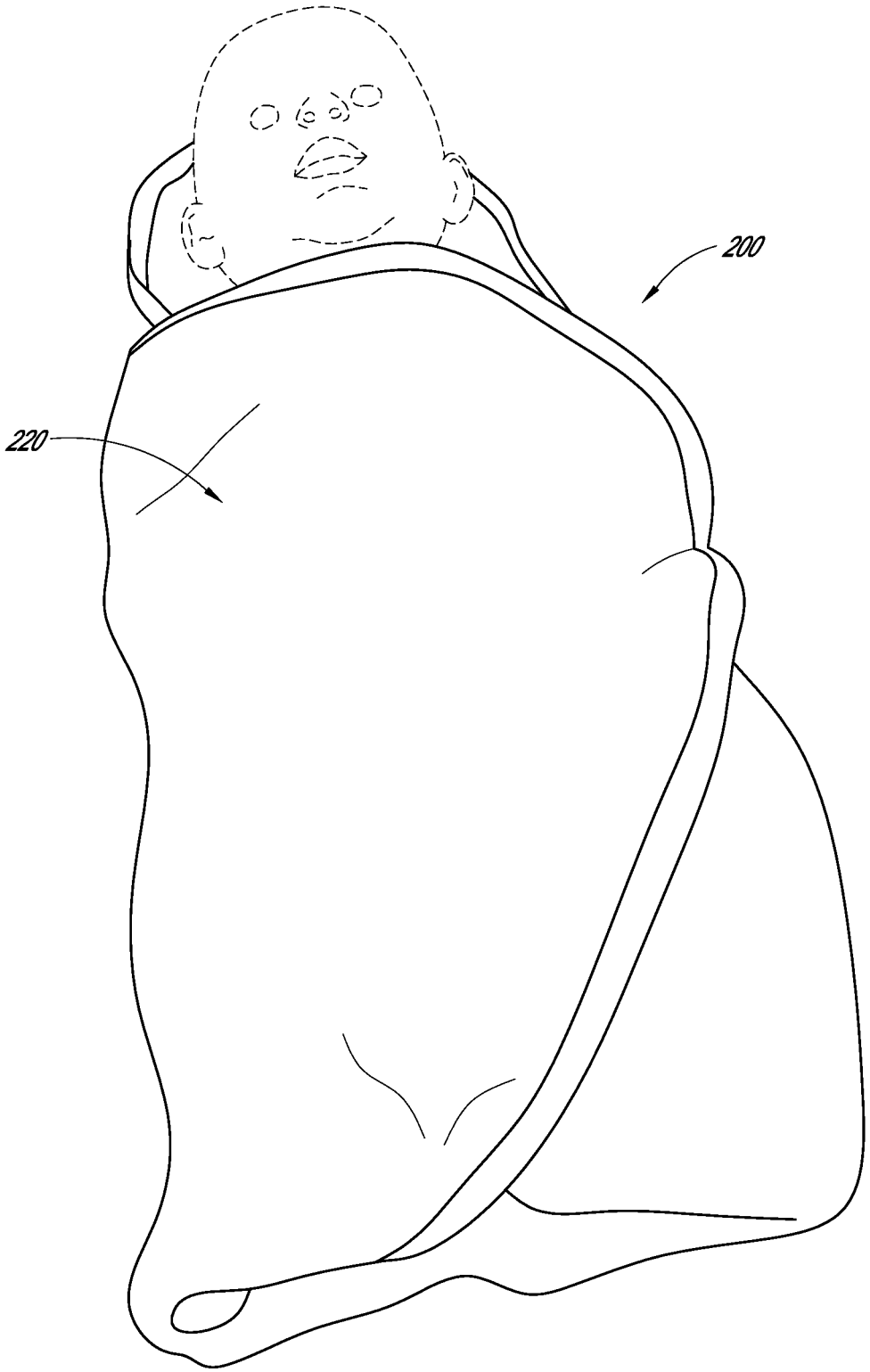
FIG. 8 is a schematic top view of the blanket assembly of FIG. 6 wrapped around a baby.
Figure 9:
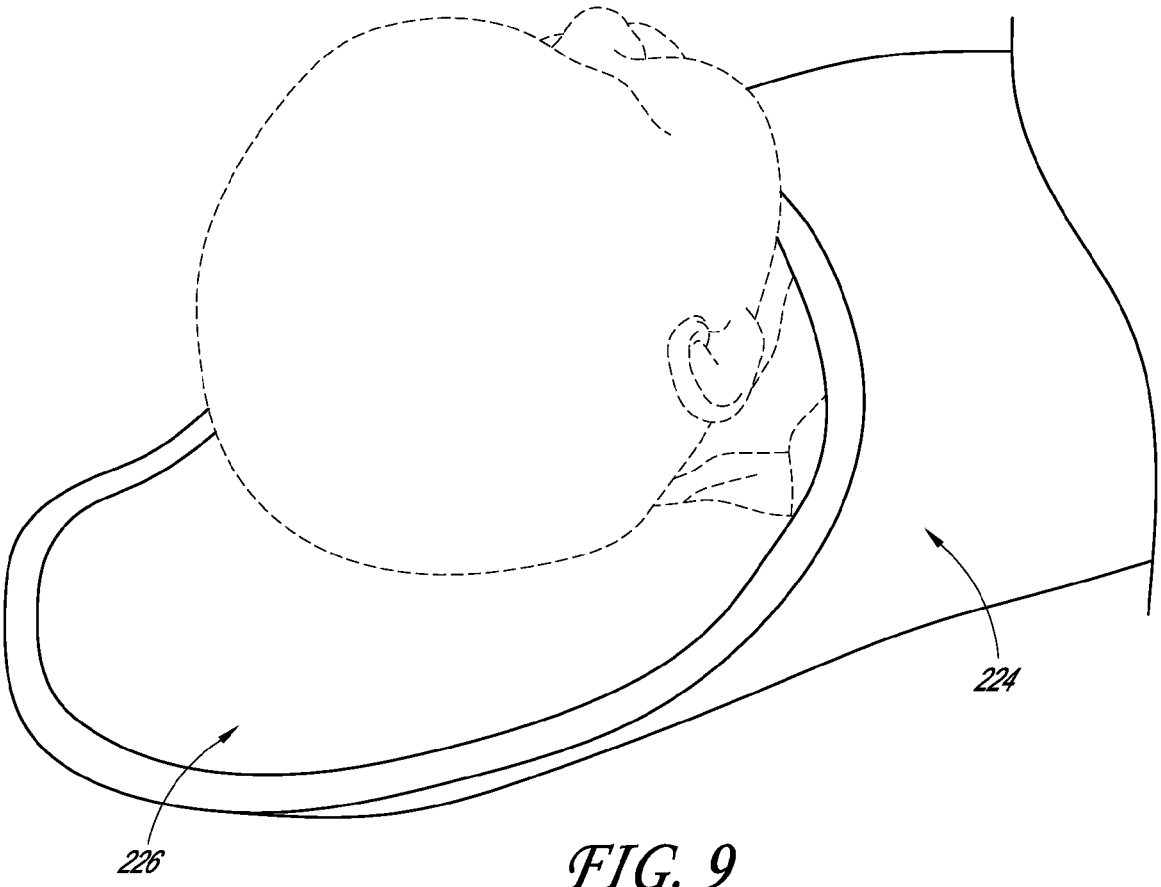
FIG. 9 is a schematic partial side view of the blanket assembly wrapped around the baby of FIG. 8.
Figure 10:
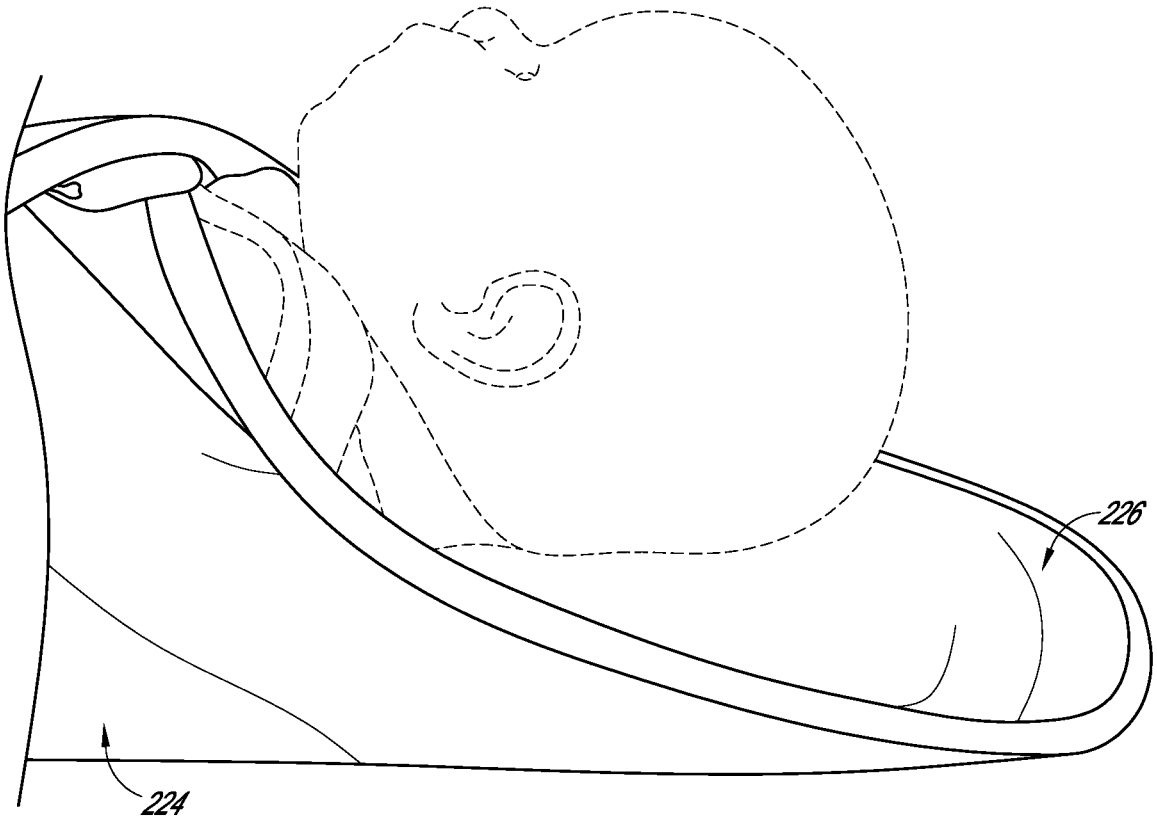
FIG. 10 is a schematic perspective partial view of a user supporting blanket assembly wrapped around a baby, as shown in FIG. 8, with one hand under the support device.

FIGS. 8-10 show the blanket assembly 200 in use. As shown in FIG. 8, the infant (e.g., newborn baby) can be placed on the top surface 224*a* of the blanket 220 so that the infant's head rests on the proximal portion 226 proximate the location of the concave section 22 of the device 100 within the blanket 220, and so that the infant's torso extends toward the center of the blanket 220 and rests over the distal portion 18 of the device 100. The blanket 220 can then be wrapped over the infant (e.g., in a swaddling configuration) so as to generally restrict movement of the infant's arms and legs. Once wrapped, the infant can be held (e.g., even by a person unfamiliar or inexperienced with holding infants, such as newborn babies) in a manner that ensures the infant's head and spine will be properly supported while being carried. As shown in FIG. 9, the blanket 220 and concave section 22 of the support device 100 comfortably support the infant's head without putting pressure on the sides of the infant's head while allowing the curved surface of the concave section 22 to comfortably accommodate the natural curvature of the infant's head. FIG. 10 shows the infant wrapped in the blanket assembly 200 and being held (e.g., supported) with one hand via the strap 234 on the back surface 22*b* of the blanket 220 (e.g., with the user's hand inserted into or through the strap 234 or pocket). Advantageously, the strap 234 allows the person holding the infant with increased flexibility in performing a variety of other tasks with their free hand while securely holding the infant with their other hand.

Figure 11A:
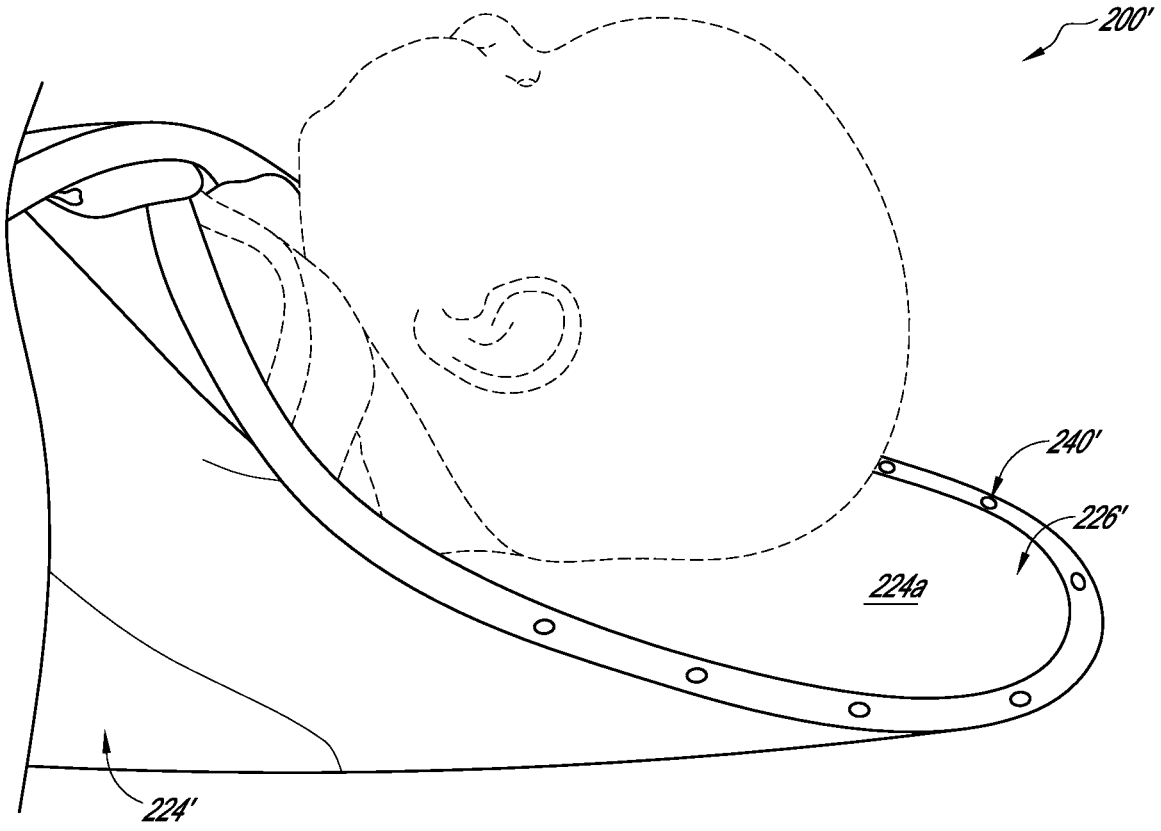
FIG. 11A is a schematic perspective partial view of a portion of one embodiment of the assembled blanket assembly wrapped around the baby of FIG. 8 with fasteners for attaching of a beanie or head cover to the blanket.
Figure 11B:
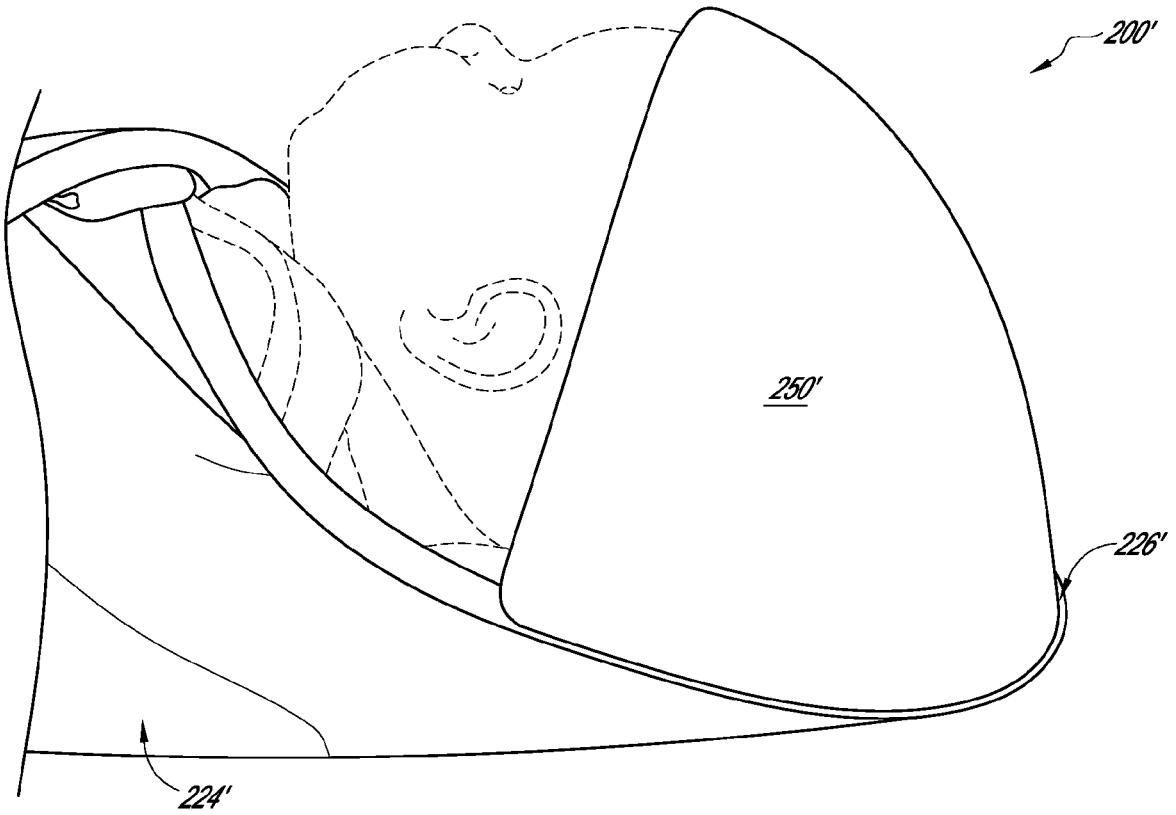
FIG. 11B is a schematic perspective partial view of the assembled blanket assembly of FIG. 11A with the beanie attached to the blanket.

FIGS. 11A-11B show another embodiment of a blanket assembly 200'. The blanket assembly 200' is identical to the blanket assembly 200 shown in FIGS. 5A-10, except as noted below. Thus, the reference numerals used to designate the various components of the blanket assembly 200' are identical to those used for identifying the corresponding components of the blanket assembly 200 in FIGS. 5A-10, except that a "'" has been added to the reference numerals.

The blanket assembly 200' can have one or more fasteners 240' disposed on the top surface 224*a'* of the proximal portion 226' of the blanket body 224'. In the illustrated embodiment, the one or more fasteners 240' are arranged along the perimeter of the proximal portion 226'. In one embodiment, the fasteners 240' can be can be buttons. In another embodiment, the fasteners 240' can be snap fasteners. In still another embodiment, the one or more fasteners 240' can be a zipper. In still another embodiment, the one or more fasteners 240' can be a hoop-and-loop fastener, such as VELCRO®. The one or more fasteners 240' can be used to removably fasten a head cover portion 250' to the proximal portion 226' of the blanket body 224'. The head cover portion 250' can then fit over the forehead of the infant to keep the infant's head warm. Advantageously, the head over portion 250' can inhibit the infant's head from moving forward (e.g., when the infant is held in an elevated position closer to vertical), thereby ensuring the infant's head and neck are properly supported even when the baby is held in a generally upright position. In one embodiment, the head cover portion 250' can be a beanie. In another embodiment, the head cover portion 250' can be shaped like a cap or have a visor portion. In one embodiment the head cover portion 250' can be made of fabric, such as cotton or wool. However, the head cover portion 250' can be made of other suitable materials. In one embodiment, the head cover portion 250' is made of the same material as the blanket 220. In another embodiment, the head cover portion 250' is made of a different material than the blanket 220.

Figure 12:
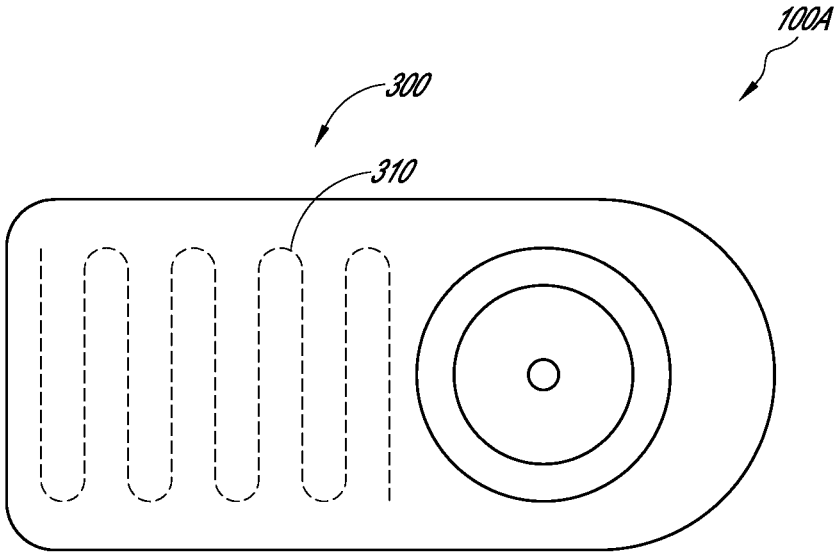
FIG. 12 is a schematic top planar view of another embodiment of a neck, spine and spinal cord support device for supporting a newborn baby or infant.
Figure 12A:
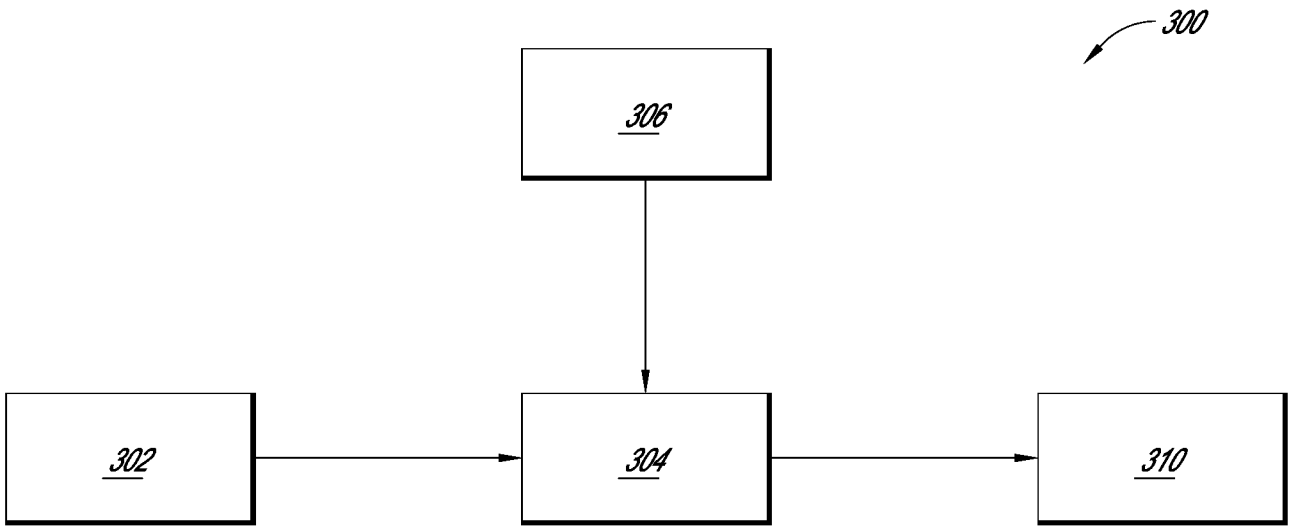
FIG. 12A is a schematic block diagram of one embodiment of a heating system for the support device of FIG. 12.

FIGS. 12-12A show another embodiment of a neck, spine and spinal cord support device 100A for supporting a newborn baby or infant. The support device 100A is similar to the support device 100 shown in FIG. 1, except as noted below. Thus, the reference numerals used to designate the various components of the support device 100A are identical to those used for identifying the corresponding components of the support device 100 in FIG. 1, except as described below.

In the illustrated embodiment, the support device 100A can include (e.g., incorporate) a heating system 300 having one or more heating elements 310 (e.g., resistive heating elements). In one embodiment, the one or more heating elements 310 can be incorporated within the body 10 (e.g., embedded in the body 10). In another embodiment, the one or more heating elements 310 can be provided on an outer surface of the body 10. In still another embodiment, the heating system 300 can be in a separate component (e.g., blanket sleeve) from the body 10, as described further below. In the illustrated embodiment, the one or more heating elements 310 are provided on the distal portion 18 of the body 10. In another embodiment, at least one of the one or more heating elements 310 can be provided in the proximal portion 20 of the body.

In one embodiment, the heating system 300 is at least partially incorporated into the body 10. In another embodiment, one or more components of the heating system 300 can be provided separate from the body 10 (e.g., in a component separate from the body 10).

The heating system 300 can include a switch 302 that can be actuated by a user to turn the heating system 300 ON and OFF. In one embodiment, the switch 302 can be provided on a surface (e.g., a bottom surface) of the body 10. The switch 302 can communicate with a controller 304 (e.g., electronic controller) that controls operation of the one or more heating elements 310. The heating system 300 can have one or more batteries 306 (e.g., low voltage batteries), that can provide power to the controller 304 and heating elements 310. In one embodiment, the heating system 310 can include a temperature sensor (e.g. at the one or more heating elements 310 or on a surface of the body 10) that communicates sensed temperature information to the controller 304.

In one embodiment, the controller 304 operates the one or more heating elements 310 a predetermined temperature setpoint. In another embodiment, the switch 302 can be operated by the user to select one of a plurality of temperature settings (e.g., low, medium, high), and the controller 304 can control the operation of the one or more heating elements 310 (e.g., control the amount of power provided by the one or more batteries 306 to the one or more heating elements 310) based upon the user selected temperature setpoint provided by the switch 302. In one embodiment, the controller 304 can include (or can be) a temperature limiting switch that can shut power to the one or more heating elements 310 if a temperature limit of the switch is exceeded. The temperature limiting switch can normally be closed during operation of the heating system 300, and can open if the temperature limit for the switch is exceeded. Advantageously, the heating system 300 can be selectively operated by a user to provide additional warmth for the baby and help keep the baby warm and comfortable in cold weather.

Figure 13:
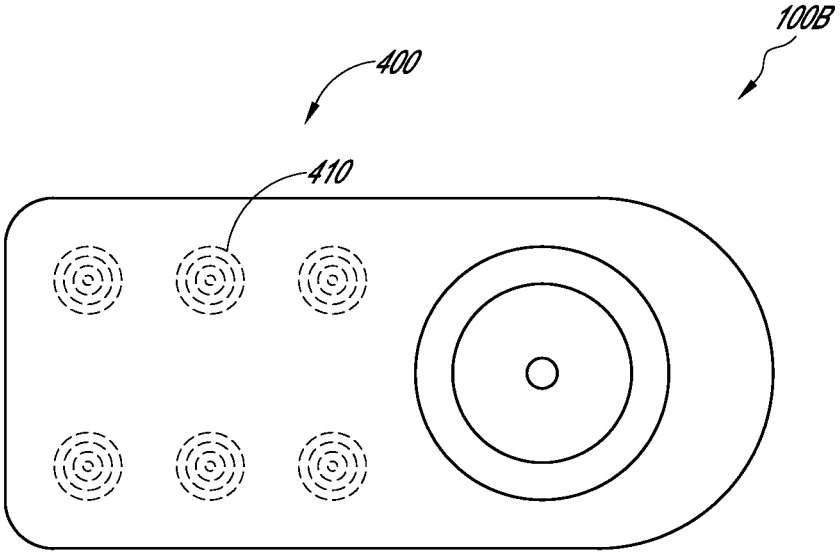
FIG. 13 is a schematic top planar view of another embodiment of a neck, spine and spinal cord support device for supporting a newborn baby or infant.
Figure 13A:
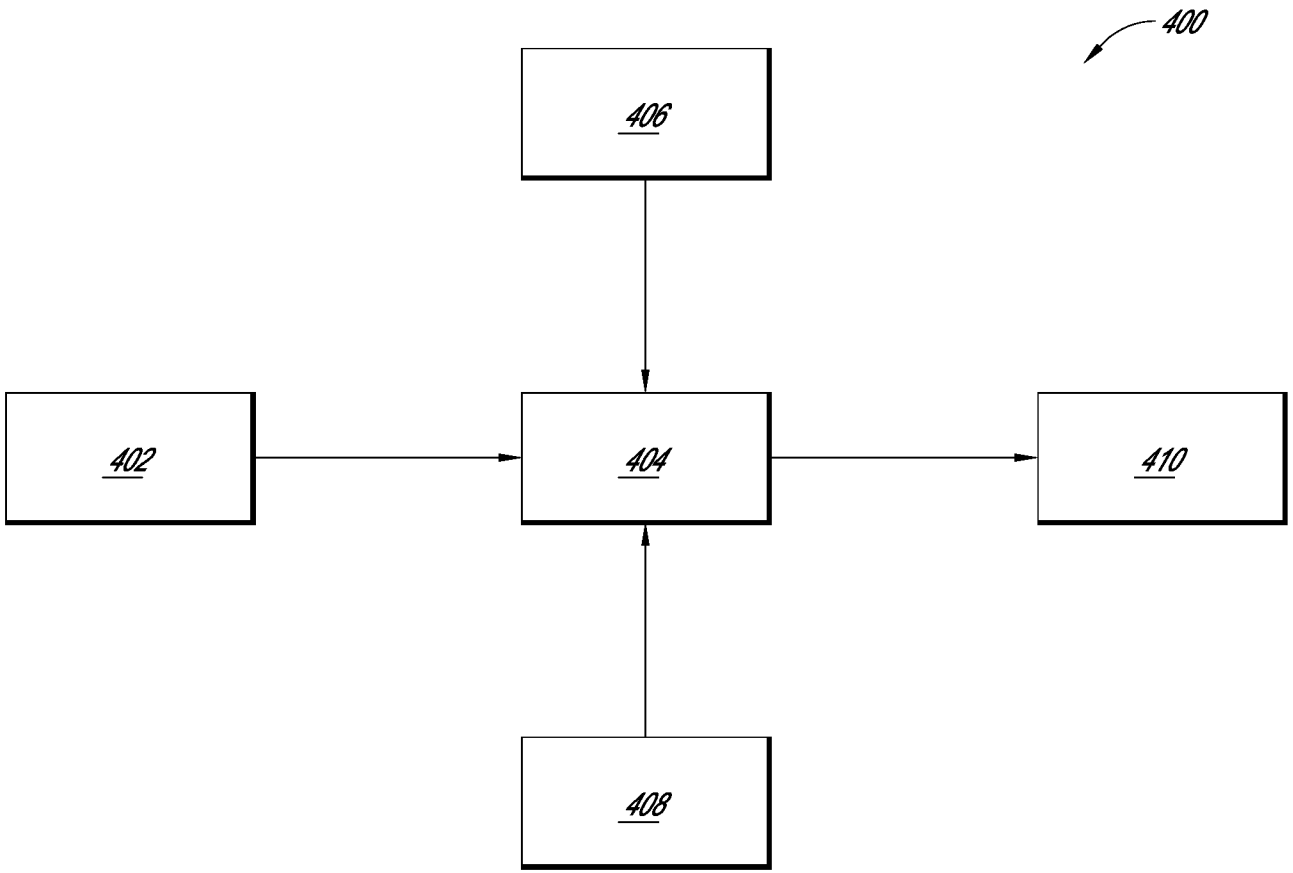
FIG. 13A is a schematic block diagram of one embodiment of a sound or vibration system for the support device of FIG. 13.

FIGS. 13-13A show another embodiment of a neck, spine and spinal cord support device 100B for supporting a newborn baby or infant. The support device 100B is similar to the support device 100 shown in FIG. 1, except as noted below. Thus, the reference numerals used to designate the various components of the support device 100B are identical to those used for identifying the corresponding components of the support device 100 in FIG. 1, except as described below.

In the illustrated embodiment, the support device 100B can include (e.g., incorporate) a sound or vibration system 400 having one or more vibration elements 410 (e.g., speakers, such as piezo speakers). In one embodiment, the one or more vibration elements 410 can be incorporated within the body 10 (e.g., embedded in the body 10). In another embodiment, the one or more vibration elements 410 can be provided on an outer surface of the body 10. In still another embodiment, the sound or vibration system 400 can be in a separate component (e.g., blanket sleeve) from the body 10, as described further below. In the illustrated embodiment, the one or more vibration elements 410 are provided on the distal portion 18 of the body 10. In another embodiment, at least one of the one or more vibration elements 410 can be provided in the proximal portion 20 of the body.

In one embodiment, the sound or vibration system 400 is at least partially incorporated into the body 10. In another embodiment, one or more components of the sound or vibration system 400 can be provided separate from the body 10 (e.g., in a component separate from the body 10).

The sound or vibration system 400 can include a switch 402 that can be actuated by a user to turn the sound or vibration system 4000N and OFF. In one embodiment, the switch 402 can be provided on a surface (e.g., a bottom surface) of the body 10. The switch 402 can communicate with a controller 404 (e.g., electronic controller) that controls operation of the one or more vibration elements 410. The sound or vibration system 400 can have one or more batteries 406 (e.g., low voltage batteries), that can provide power to the controller 404 and vibration elements 410. The sound or vibration system 400 can also include a memory 408 that can store one or more sounds (e.g., heart beat, breathing sound), and which can communicate such one or more sounds with the one or more vibration elements 410 via the controller 404. In one embodiment, the sound or vibration system 400 can allow the user to record user selected sounds (e.g., Mother's heartbeat, breathing, and/or voice) to the memory 408.

In one embodiment, the controller 404 operates the one or more vibration elements 410 to provide a predetermined sound or vibration. In another embodiment, the switch 402 can be operated by the user to select one of a plurality of sound settings (e.g., heart beat, breathing, ocean waves), and the controller 404 can control the operation of the one or more vibration elements 310 (e.g., control the amount of power provided by the one or more batteries 406 to the one or more vibration elements 410, or the sound broadcast by the vibration elements 410 via the memory 408) based upon the user selected sound setting provided by the switch 402. In one embodiment, the controller 404 can include a sound limiting switch that can shut power to the one or more vibration elements 410 if the sound level exceeds a predetermined decibel level. The sound limiting switch can normally be closed during operation of the sound or vibration system 400, and can open if the decibel limit for the switch is exceeded. Advantageously, the sound or vibration system 400 can be selectively operated by a user to provide sounds and/or vibrations to comfort and soothe the baby while being supported on the support device 100B.

Figure 14:
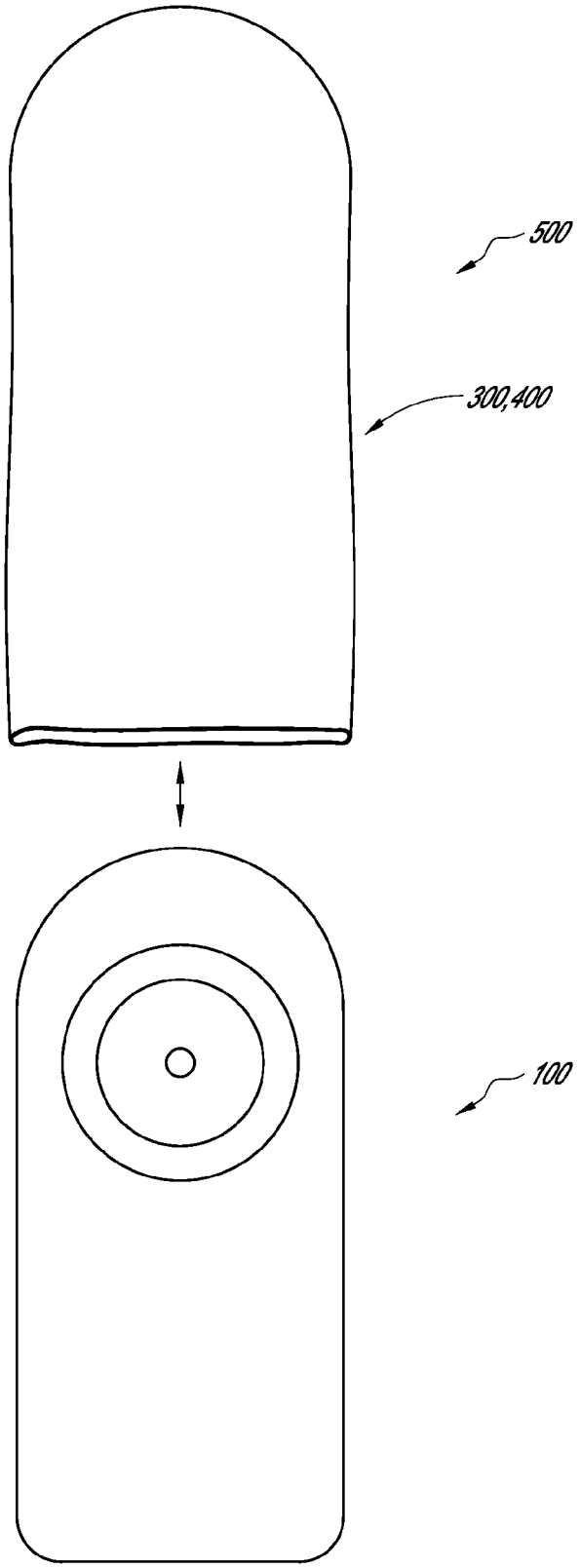
FIG. 14 is a schematic top planar view of one embodiment of a sleeve having a heating and/or sound/vibration system that receives the support device of FIG. 1.

FIG. 14 shows another embodiment, where the heating system 300 and/or sound/vibration system 400 can be provided in a separate sleeve 500, which can be slipped over the support device 100 to provide a support system that provides heating and/or sound/vibration to the baby while supported on the support device 100. Where the heating system 300 and sound/vibration system 400 are combined, a single switch can operate as the switches 302, 402, a single controller can operate as the controllers 304, 404, and a single battery pack can provide the one or more batteries 306, 406.

In one embodiment, the sleeve 500 can be like a heated blanket that can be used to cover the support device 100 so as to provide the heating system 300, as well as cushioning. In one embodiment, once the sleeve 500 is slipped over the support device 100, the combined structure can be inserted into the pocket 228 of the blanket assembly 200. In another embodiment, the blanket assembly 200 can incorporate the heating system 300 or sound/vibration system 400 into the blanket 220.

Of course, the foregoing description is of certain features, aspects and advantages of the present invention, to which various changes and modifications can be made without departing from the spirit and scope of the present invention. Thus, for example, those skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or sub-combinations of the specific features and aspects between and among the different embodiments may be made and still fall within the scope of the invention. Accordingly, it should be understood that various features and aspects of the disclosed embodiments can be combined with or substituted for one another in order to form varying modes of the discussed devices, systems and methods (e.g., by excluding features or steps from certain embodiments, or adding features or steps from one embodiment of a system or method to another embodiment of a system or method).

What is claimed is:

1. A blanket assembly for swaddling an infant, comprising:

a blanket body defining a pocket between an upper layer and a lower layer of the body at one end of the blanket body, the pocket accessible via an opening selectively closeable to seal the pocket; and a neck, spine and spinal cord support device having a body extending between a bottom edge, a top edge and two side edges of the support device, the body having a top surface and a bottom surface, the support device further having a concave section defined in a proximal portion of the body, at least a portion of the concave section extending below a bottommost edge of a rest of the body and having a generally circular perimeter defined on the top surface, a distal portion of the body configured to support an infant's torso and the concave section configured to at least partially receive and support the infant's head, the support device having a circumference smaller than a circumference of the blanket body and being removably insertable in the pocket of the blanket body and secured within the blanket body by the pocket so as to maintain the support device in a substantially fixed position within the blanket body, wherein the support device is configured to support the head, neck, spine and spinal cord of the infant when the infant is laid on the blanket body in a supine position and wrapped in the blanket body, and so as to inhibit injury to the infant's head, neck, spine and spinal cord while carried by a person.

2. The assembly of claim 1, wherein the opening is selectively closed by one or more fasteners.

3. The assembly of claim 1, further comprising a strap on a back surface of the blanket body, the strap sized to at least partially receive the person's hand therethrough such that the person can support the wrapped infant with a single hand.

4. The assembly of claim 1, further comprising a head cover portion removably attachable to a proximal portion of the blanket body, the head cover portion configured to fit over at least a portion of the infant's head and configured to maintain the infant's head in a substantially fixed position against the proximal portion of the blanket body when the infant is held in a generally upright position.

5. The assembly of claim 1, further comprising one or more heating elements selectively actuatable by a user to provide a predetermined amount of heat to the infant when the infant is supported on the support device so as to keep the infant warm.

6. The assembly of claim 1, further comprising one or more sound and vibration elements selectively actuatable to provide one or more sounds or vibrations to the infant while the infant is supported on the support device in order to soothe the infant.

7. The assembly of claim 6, wherein the one or more sounds or vibrations comprises one or more of a heartbeat and a breathing sound or vibration.

8. The assembly of claim 7, wherein the support device is monolithic.

9. A neck, spine and spinal cord support device for supporting an infant, comprising:

a monolithic body extending between a bottom end and a top end that at least partially defines a boundary of the body, the body having a top surface and a bottom surface, the body having a length so that the body extends from above an infant's head to below the infant's buttocks, thereby allowing the infant's legs and feet to be free to move or be tucked for comfort while the infant is supported on the support device; and a concave section defined in a proximal section of the body, at least a portion of the concave section extending below the bottom surface of the monolithic body, wherein a distal portion of the monolithic body is configured to support the infant's torso and wherein a cavity defined by an inner surface of the concave section is configured to at least partially receive and support the infant's head so that the monolithic body supports the head, neck, spine and spinal cord of the infant in an aligned orientation when the infant is laid in supine position on the monolithic body.

10. The device of claim 9, wherein the body has a thickness of between about 0.05 inches and about 1 inch.

11. The device of claim 9, further comprising one or more heating elements selectively actuatable to provide a predetermined amount of heat to the infant when the infant is supported on the support device so as to keep the infant warm.

12. The device of claim 9, further comprising one or more sound and vibration elements selectively actuatable to provide one or more sounds or vibrations to the infant while the infant is supported on the support device in order to soothe the infant.

13. The device of claim 12, wherein the one or more sounds or vibrations comprises one or more of a heartbeat and a simulated breathing sound or vibration.

* * * * *

UNITED STATES PATENT AND TRADEMARK OFFICE

CERTIFICATE OF CORRECTION

PATENT NO. : 8,938,830 B2
APPLICATION NO. : 14/191060
DATED : January 27, 2015
INVENTOR(S) : Steven Paperno It is certified that error appears in the above-identified patent and that said Letters Patent is hereby corrected as shown below:

In the specification,

At column 1, line 17, please delete "new born" and insert --newborn--, therefor.

At column 4, line 3, please delete "abut" and insert --about--, therefor.

At column 7, line 63, please delete "4000N" and insert --400 ON--, therefor.

In the claims,

At column 10, line 26, in Claim 9, please delete "the bottom surface" and insert --a bottommost edge of a rest--, therefor.

Signed and Sealed this
First Day of March, 2016

Michelle K. Lee

Michelle K. Lee
*Director of the United States Patent and Trademark Office*